US009272317B2

(12) United States Patent
Muschalik

(10) Patent No.: US 9,272,317 B2
(45) Date of Patent: Mar. 1, 2016

(54) METHOD FOR OPERATION OF AN INDIRECT EXTRUSION PRESS AND AN INDIRECT EXTRUSION PRESS

(71) Applicant: SMS Meer GmbH, Moenchengladbach (DE)

(72) Inventor: Uwe Muschalik, Duisburg (DE)

(73) Assignee: SMS Meer GmbH, Moenchengladbach (DE)

( * ) Notice: Subject to any disclaimer, the term of this patent is extended or adjusted under 35 U.S.C. 154(b) by 139 days.

(21) Appl. No.: 14/277,407

(22) Filed: May 14, 2014

(65) Prior Publication Data

US 2014/0338415 A1 Nov. 20, 2014

(30) Foreign Application Priority Data

May 16, 2013 (DE) ..... 10 2013 008 345

(51) Int. Cl.
*B21C 35/02* (2006.01)
*B21C 35/04* (2006.01)
(Continued)

(52) U.S. Cl.
CPC ..... *B21C 35/02* (2013.01); *B21C 23/205* (2013.01); *B21C 23/214* (2013.01); *B21C 23/218* (2013.01); *B21C 26/00* (2013.01); *B21C 35/04* (2013.01); *B21C 35/06* (2013.01)

(58) Field of Classification Search
CPC .... B21C 23/21; B21C 23/211; B21C 23/212; B21C 23/214; B21C 23/215; B21C 23/218; B21C 23/20; B21C 23/205; B21C 26/00; B21C 35/02; B21C 35/04; B21C 35/06
USPC ..... 72/31.13, 253.1, 254, 255, 263, 273.5
See application file for complete search history.

(56) References Cited

U.S. PATENT DOCUMENTS 3,522,721 A 8/1970 Whiting
4,430,877 A * 2/1984 Aasari ..... B21C 23/218 72/255

(Continued)

FOREIGN PATENT DOCUMENTS

DE 2 237 276 A1 2/1973
DE 31 52 045 A1 7/1982

(Continued)

OTHER PUBLICATIONS

European Office Action in 14001406.9-1702, dated Jan. 26, 2015, with English translation of relevant parts.

(Continued)

*Primary Examiner* — Peter DungBa Vo
*Assistant Examiner* — Joshua D Anderson
(74) *Attorney, Agent, or Firm* — Collard & Roe, P.C.

(57) ABSTRACT

In a method for operating an indirect extrusion press, wherein the indirect extrusion press includes an indirect punch having a tool head that can be accommodated on the indirect punch, a closure piece, and a longitudinally movable block holder having a material block accommodation for accommodating a material block, after pressing a material block and forming a shell in a shell chamber, a tool head to be replaced is pushed out of the block holder by a tool head to be inserted, so that very operationally reliable removal of a shell formed during one or more pressing procedures is possible. For this purpose, an indirect extrusion press can have a maximal distance between a closure piece and an indirect punch that corresponds at least to the sum of the expanses of the tool head and of the block holder in the movement direction.

5 Claims, 9 Drawing Sheets

(51) Int. Cl.

| | |
|---|---|
| ***B21C 23/21*** | (2006.01) |
| ***B21C 23/20*** | (2006.01) |
| ***B21C 26/00*** | (2006.01) |
| *B21C 35/06* | (2006.01) |

(56) References Cited

U.S. PATENT DOCUMENTS

| | | | |
|---|---|---|---|
| 4,459,837 | A | 7/1984 | Hayashi et al. |
| 4,745,789 | A | 5/1988 | Richardt et al. |
| 4,989,437 | A | 2/1991 | Bessey et al. |

FOREIGN PATENT DOCUMENTS

| | | | |
|---|---|---|---|
| EP | 0 037 485 | A1 | 10/1981 |
| EP | 0 329 567 | A1 | 8/1989 |
| EP | 0 224 115 | B1 | 4/1991 |
| FR | 2 148 704 | A5 | 3/1973 |
| JP | S50-28467 | A | 3/1975 |
| JP | S56-136221 | A | 10/1981 |
| JP | S59-73012 | A | 4/1984 |
| JP | S59-73012 | U | 5/1984 |
| JP | S61-4813 | A | 1/1986 |
| WO | 01/68283 | A1 | 9/2001 |
| WO | 2012/092923 | A2 | 7/2012 |

OTHER PUBLICATIONS

German Office Action in German Application No. 10 2013 008 345.1, dated Apr. 15, 2014, with an English translation of the relevant parts of same.

Chinese Office Action in 201410208673.6, issued Sep. 11, 2015.

Notification of Reason for Refusal in 2014-097621, mailed Jul. 28, 2015.

* cited by examiner

METHOD FOR OPERATION OF AN INDIRECT EXTRUSION PRESS AND AN INDIRECT EXTRUSION PRESS

CROSS REFERENCE TO RELATED APPLICATIONS

Applicant claims priority under 35 U.S.C. §119 of German Application No. 10 2013 008 345.1 filed May 16, 2013, the disclosure of which is incorporated by reference.

BACKGROUND OF THE INVENTION

1. Field of the Invention

The invention relates to a method for operation of an indirect extrusion press and an indirect extrusion press.

2. Description of the Related Art

During indirect pressing of crude metal blocks, the forming procedure to produce the pressed product takes place with the formation of a shell, for example. The crude metal blocks may be made, for example, of copper, brass or corresponding alloys, and the shell is formed in order to avoid contaminants on the surface of the block to be formed from getting into the finished pressed product. In this connection, a tool head comprising a die plate is kept smaller in its diameter than the inside diameter of a block, to such an extent that a shell having a wall thickness of about 0.2 mm to 2.0 mm remains on the inner wall of the block holder, in each instance, as is also disclosed, for example, in EP 0 224 115 B1. The formation of a shell can also be correspondingly advantageous in the case of other materials, for example aluminum.

In this connection, a distinction should be made between direct and indirect pressing procedures, whereby in direct pressing, larger pressed products can generally be produced, with guidance of a pressing punch and of the metal to be formed in the same direction. In indirect pressing, in which the pressing punch is called an indirect punch and the material are guided in opposite directions, significantly lower friction forces generally occur, because the material does not need to be displaced relative to the block holder. In general, however, only smaller pressed products can be produced in indirect pressing, because the pressed product must be discharged through the indirect punch.

To reduce material tensions in the indirect punch, DE 101 31 901 A1 proposes screwing a clearing ring onto the indirect punch and relieving stress with a counter-nut. Alternatively, a wear plate and/or a die plate is attached by way of insertion bolts that are shrunk-fit into corresponding bores of the indirect punch.

After one or more pressing procedures, the shell that has formed as a result of pressing of the block material must generally be removed, in order to be able to implement operationally reliable pressing for subsequent pressing procedures. In known methods, in order to remove the shell, the latter is pulled out of the block holder together with the tool head, accompanied by great disassembly effort and assembly effort. Almost complete removal of the shell from the block holder, without remnant, however, is not possible in this way. Moreover, a remaining remnant of the shell has a detrimental effect on subsequent pressing procedures or on the operational reliability of subsequent pressing procedures. This detrimental effect results because the remaining remnant can lead, particularly during pressing, to undesirable block compression of the metal block or material block during the loading procedure that is intended for the subsequent pressing procedure. Furthermore, the remaining remnant of the shell can hinder secure introduction of a new tool head or of a cleaned or repaired tool head into the block holder. In particular, the tool head can become jammed on the remaining remnant.

SUMMARY OF THE INVENTION

It is the task of the present invention to indicate a method for the operation of an indirect extrusion press and an indirect extrusion press, with which operationally reliable removal of a shell that has been formed during one or more pressing procedures is possible.

This task is accomplished with a method for operation of an indirect extrusion press in accordance with one aspect of the invention, and with an indirect extrusion press in accordance with another aspect of the invention. Further advantageous embodiments are found in the following description.

In the operation of an indirect extrusion press, operationally reliable removal of the shell can be implemented, as compared with known methods, using the following steps, (A) bringing the indirect punch out of the material block accommodation by moving the block holder in the direction of the closure piece, (B) placing a further tool head between indirect punch and material block accommodation and accommodating the further tool head on the indirect punch, (C) introducing the indirect punch, together with the accommodated further tool head, into the material block accommodation, and bringing the further tool head into contact with the other tool head, by moving the block holder in the opposite direction, and (D) pushing the other tool head out of the material block accommodation by moving the block holder further in the opposite direction, whereby the shell is pressed out of the material block accommodation, in part or in its entirety, during the further movement, by the further tool head.

In the known methods, a shell that has been formed by means of pressing of the material block(s) is removed, in complicated manner, by means of pulling the tool head, in each instance, out of the block holder. In contrast to the known methods, significantly more operationally reliable removal of the shell can be implemented by means of providing Steps A to D, particularly in that according to Step D, the shell or the shell that has formed can be pressed out of the material block accommodation, in part or in its entirety, by means of pushing the other tool head out of the material block accommodation, as provided. This reliability is particularly a consequence of the circumstance that pressing the shell out of the material block accommodation can be undertaken by the further tool head, in guided manner, in the material block accommodation. Complicated removal by means of pulling or partially pulling the shell out of the block holder together with the tool head, as provided in known methods—which is possible only with the acceptance of a certain unavoidable lack of operational reliability, such as, for example, the tool head falling out or tilting—can be advantageously eliminated.

The shell can furthermore be advantageously removed from the block holder or from the material block accommodation without remnant or almost without remnant, by means of suitable process management, particularly during the implementation of Step D.

Particularly by introducing the indirect punch, together with the accommodated further tool head, into the material block accommodation, and bringing the further tool head into contact with the other tool head by moving the block holder in the opposite direction, as undertaken in (C), it can be ensured that the further tool head performs a movement with regard to the block holder that corresponds to its movement during indirect pressing itself. As a result, possible shell remnants within the block holder are also treated in operationally reliable manner, just like the pressed material itself, in the case of suitable process management. In particular, a peeling ring of the further tool head can act accordingly on possible remnants within the material block.

If, in Step D, during the further movement, the shell is partially pressed out of the material block accommodation by the further tool head, then in Step D, after the shell is partially pressed out of the material block accommodation, an excess length formed by means of the shell being partially pressed out can be separated from a remnant of the material. This method of procedure is particularly advantageous if the existence of a certain remnant of the material cannot be avoided due to default values of the design or process technology, or if such a remnant is actually desired. It is particularly advantageous that the excess length can be sheared off by means of a shearing blade in order to separate it.

In Step B of the method, the further tool head can be disposed between indirect punch and material block accommodation block holder by a manipulator of an industrial robot, and accommodated on a further tool head. Step B can be carried out with very great process reliability by means of the use of a manipulator.

In Step D, the other tool head can be pushed into a predetermined position on a manipulator or in the surroundings of a manipulator of an industrial robot when it is pushed out. Subsequently, the other tool head can be grasped by the manipulator and moved away from the block holder. Step D can also be carried out with very great process reliability by the use of the manipulator of an industrial robot in Step D.

A high degree of automation can also be advantageously achieved by means of suitable inclusion in the entire method sequence, on the basis of provision of a manipulator in Steps B and C, in the manner described above.

Operationally reliable removal of the shell can particularly be implemented cumulatively or alternatively to the above explanations, by means of an indirect extrusion press that comprises an indirect punch having a tool head that can be accommodated on the indirect punch, a closure piece, and a longitudinally movable block holder having a material block accommodation for accommodating a material block. The block holder can be moved in a straight line, in a movement direction, by the closure piece, by way of the indirect punch. The indirect punch can be brought out of the material block accommodation by moving the block holder in the direction of the closure piece and introduced into the accommodation by being moved in the opposite direction. The closure piece can be moved in a straight line from a maximal position with a maximal distance from the indirect punch toward the indirect punch. The indirect extrusion press is characterized in that in the maximal position, the maximal distance between the closure piece and the indirect punch corresponds at least to the sum of the expanses of the tool head and of the block holder in the movement direction.

By means of providing this maximal distance, Step B of the above method can be carried out in operationally reliable manner, in simple manner, and thereby also operationally reliable removal of a shell that has been formed can be made possible. Operationally reliable implementation of Step B is made possible in that undisturbed placement of the further tool head between indirect punch and material block accommodation can be guaranteed by means of the maximal distance made available, if the closure piece is in the maximal position or was previously moved into this maximal position. Nevertheless, other ways of managing the method, which might not be quite as operationally reliable, are also possible. For example, a tool head may be at first ejected entirely and subsequently a new tool head may be inserted, after the block holder was displaced as far as possible in the direction of the closure piece.

Particularly preferably, the maximal distance is configured to be more than 2 mm greater than the sum, in order to be able to carry out the placement of the further tool head between indirect punch and material block accommodation in Step B of the method in very operationally reliable manner and, in particular, with sufficient play. In particular, a distance of 4 mm, in total, is advantageous for an operationally reliable sequence, so that 2 mm distance are available on both sides of the tool head on both sides, in each instance, for a normal tool head replacement.

Preferably, the tool head can have a conical section that narrows in the pressing direction of the indirect extrusion press or in the opposite direction. This section is provided for forming a shell chamber of the indirect extrusion press, which chamber is delimited by the narrowing section and the inner wall of the material block accommodation that delimits the material block accommodation. By means of providing the narrowing conical section, the tool head can advantageously be released from the clamping by the shell, specifically particularly by means of pushing the tool head out of the material block accommodation counter to the pressing direction, as is particularly provided for the other tool head in Step D.

Preferably, the indirect punch comprises a peeling ring that delimits the shell chamber in the pressing direction and can be released from the tool head. In this manner, separation of the tool head from the peeling ring or from the indirect punch can be undertaken in very simple manner. Likewise, it is easily possible to place a new tool head in front of the peeling ring.

It is understood that the characteristics of the solutions described above and in the claims can also be combined, if necessary, in order to be able to implement the advantages in correspondingly cumulative manner.

BRIEF DESCRIPTION OF THE DRAWINGS

Further advantages, goals, and properties of the invention will be explained using the following description of exemplary embodiments, which are particularly also shown in the attached drawing. The drawing shows.

DETAILED DESCRIPTION OF PREFERRED EMBODIMENTS

Figure 1:
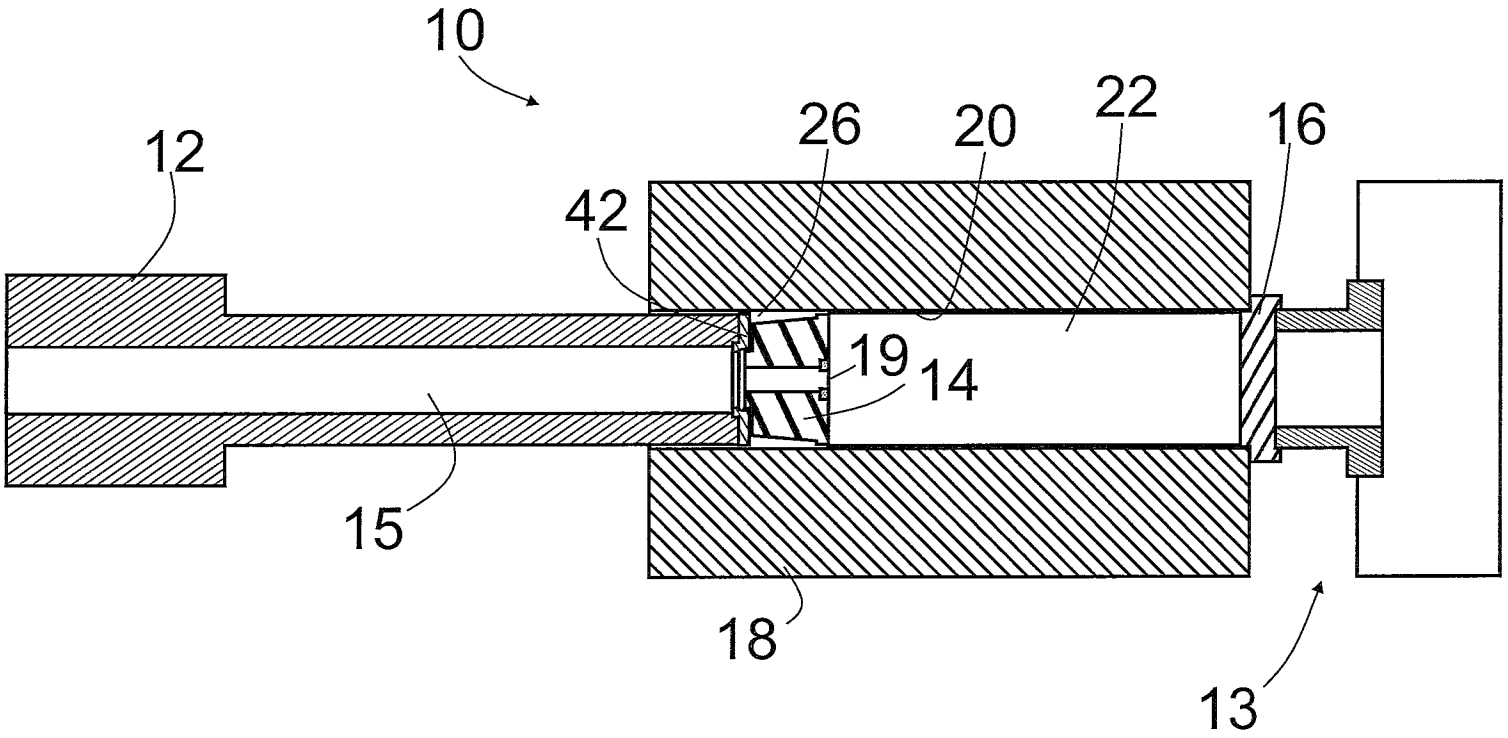
FIG. 1 is a schematic representation of an indirect extrusion press, together with a material block intended for pressing.

The exemplary embodiment of an indirect extrusion press 10 shown in FIG. 1 comprises an indirect punch 12 having a tool head 14 that can be accommodated on the indirect punch 12, a pressing punch 13 having a closure piece 16, and a longitudinally movable block holder 18 having a material block accommodation 20 for accommodating a material block 22. The indirect punch 12 furthermore comprises a peeling ring 42.

The material block 22 that can be pressed to produce a pressed product by means of the indirect extrusion press 10 is a material block 22 that can consist, at least in part or in its entirety, of a metallic material, such as, for example, aluminum, copper, brass or corresponding alloys.

The block holder 18 can be moved in a straight line by the closure piece 16, by way of the indirect punch 12. The indirect punch 12 can be brought out of the material block accommodation 20 by moving the block holder 18 in the direction of the closure piece 16. Therefore the indirect punch 12 can be introduced into the material block accommodation 20 by moving the block holder 18 in the opposite direction (see, in this regard, also FIG. 4). Because essentially relative movements are involved, in this connection, it is understood that in deviating embodiments, the indirect punch can also be movable, while other modules are merely configured to be stationary.

Figure 2:
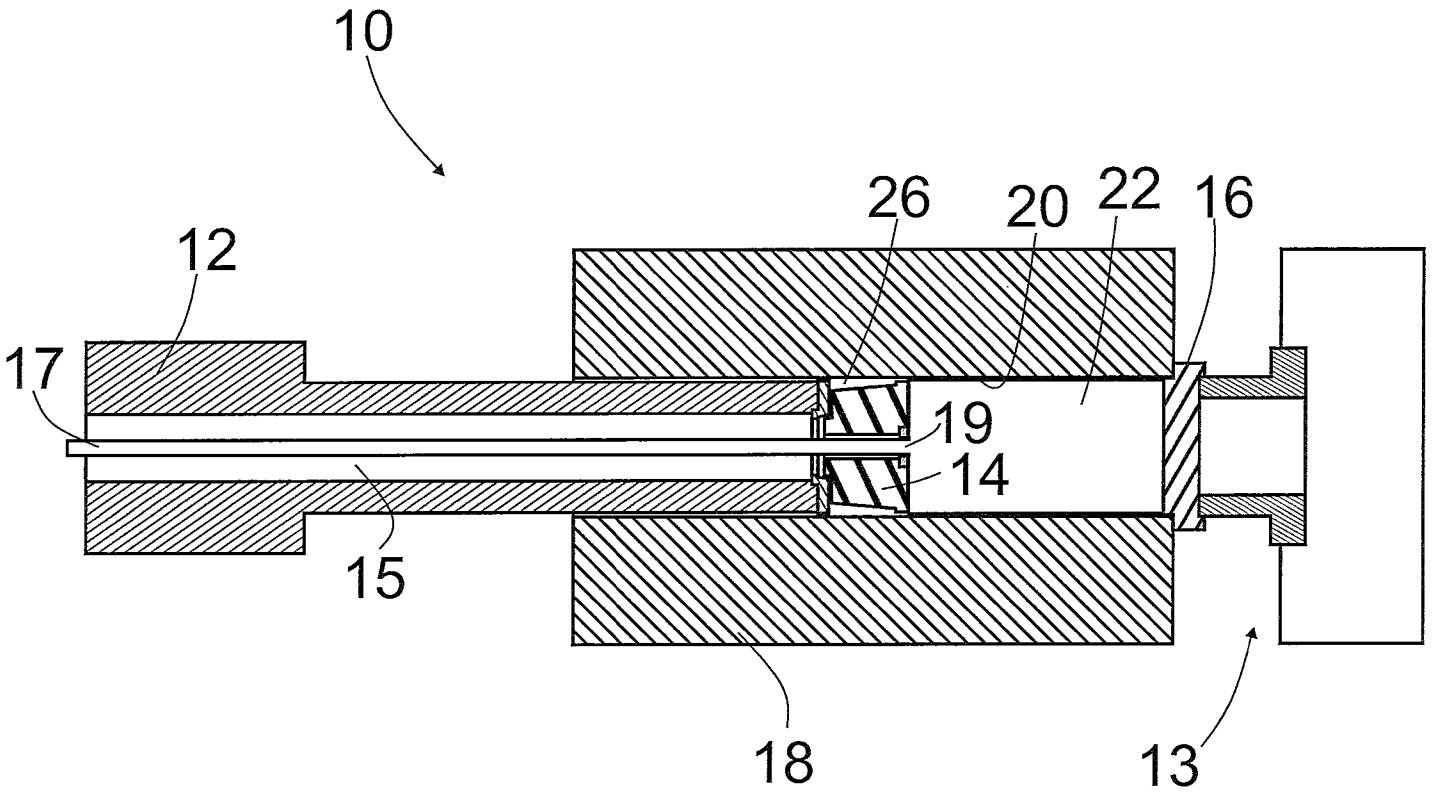
FIG. 2 is a schematic representation of the indirect extrusion press according to FIG. 1 in an operating state in which a section of the material block was already pressed to form a pressed product.

In the operating state illustrated in FIG. 2, a section of the material block 22 introduced into the material block accommodation 20 was already pressed to produce a pressed product 17 in the form of a tube, by being pressed through a die plate 19 of the tool head 14, by means of displacement of the block holder 18 and of the material block 22 by means of the closure piece 16 or by means of the pressing punch 13; this product was discharged by way of a cavity 15 provided in the indirect punch 12.

Figure 3:
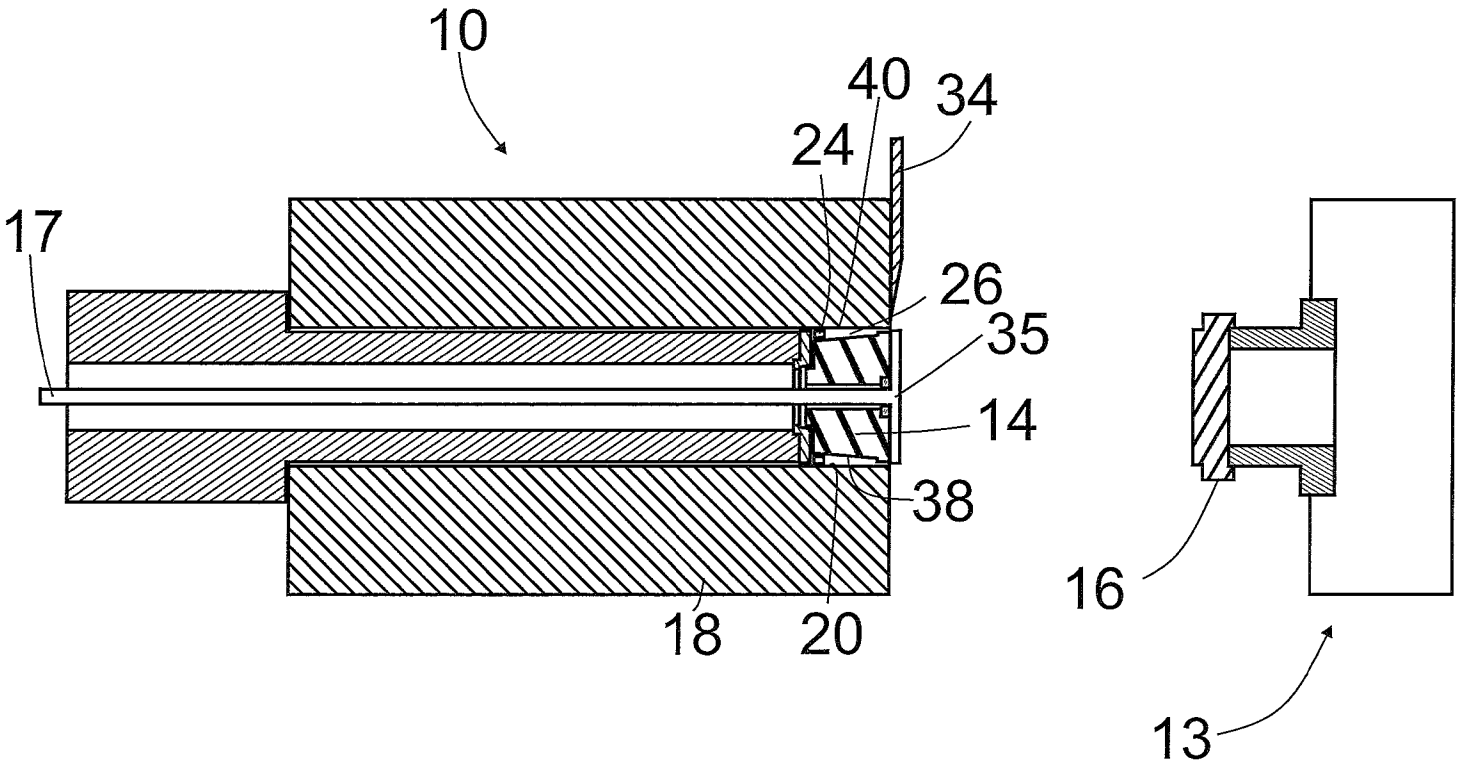
FIG. 3 is a schematic representation of the indirect extrusion press according to FIGS. 1 and 2 in an operating state in which the material block was already completely pressed to form a pressed product.

FIG. 3 illustrates the operating state of the indirect extrusion press 10 in which the material block 22 was completely pressed to produce a pressed product 17. The shearing blade 34 provided serves for shearing off a pressing remnant 35 formed during the pressing procedure, after being stripped out or pressed out of the material block accommodation 20 by the tool head 14 or the block holder 18, and, in this connection, separating it from a shell 24 that is also formed during the pressing procedure, which is situated in a shell chamber 26 of the indirect extrusion press 10, whereby the shell chamber 26 is disposed radially around the tool head 14.

To form the shell chamber 26, the tool head 14 has a conical section 38 that narrows in the pressing direction of the indirect extrusion press 10 or in the opposite direction, whereby the shell chamber 26 is delimited by the narrowing section 38 and the inner wall 40 of the material block accommodation 20, in other words the inner wall 40 that delimits the material block accommodation 20.

FIGS. 4 to 8 serve to illustrate an exemplary embodiment of the method for operating the indirect extrusion press 10. After the material block 22 is pressed and the shell 24 is formed in the shell chamber 26, Steps A to D explained in greater detail below are provided in the exemplary embodiment of the method to be illustrated here.

Figure 4:
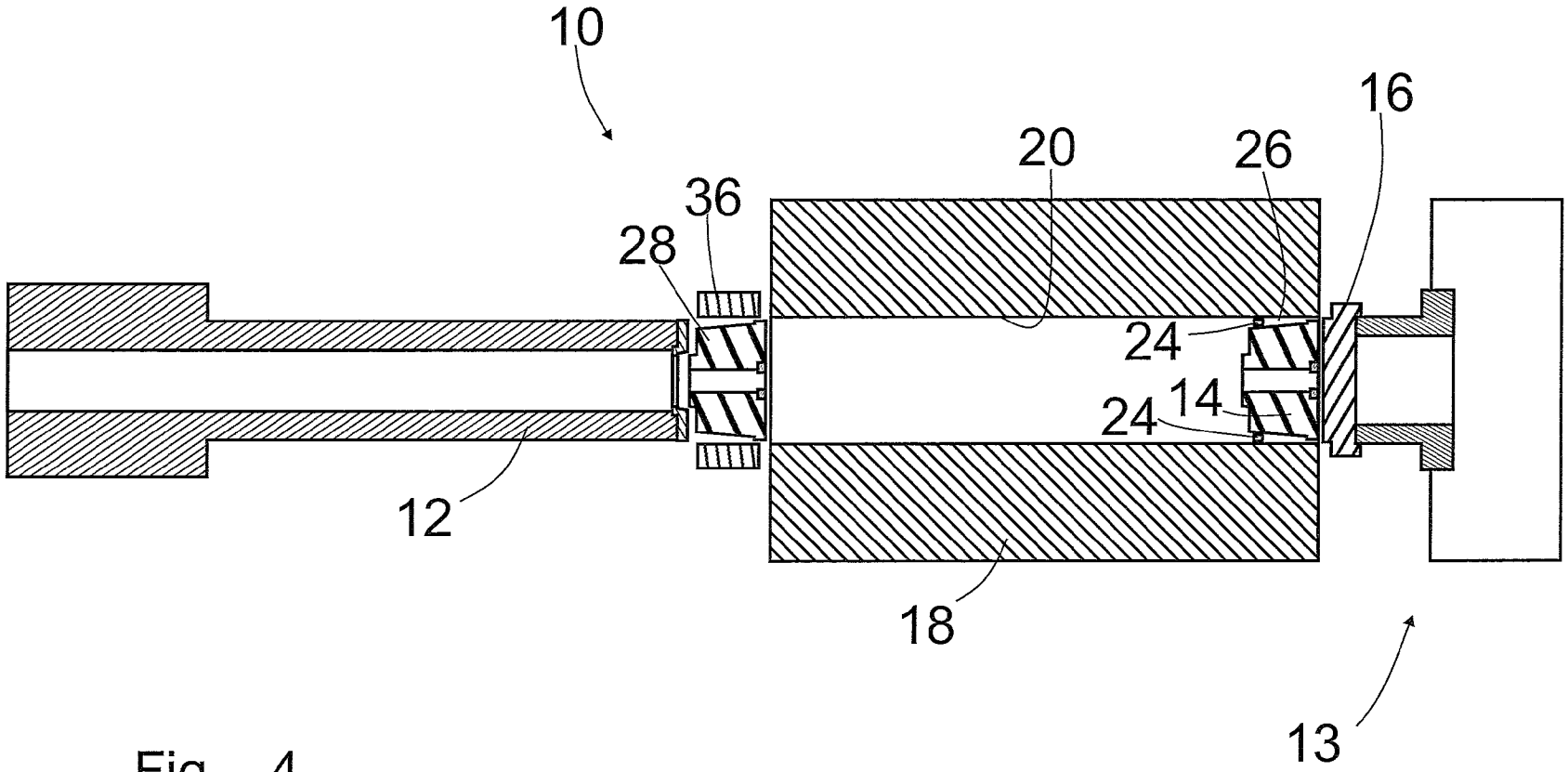
FIGS. 4-8 are each a schematic representation of the indirect extrusion press according to FIGS. 1 to 3, having two tool heads, whereby the representations are provided to illustrate an exemplary embodiment of the method for operating an indirect extrusion press.

Thus, FIG. 4 illustrates the situation or the operating state after Step A has been carried out and while Step B of the method is being carried out. In other words, what is illustrated in FIG. 4 is the situation or the operating state after the indirect punch 12 has been brought out of the material block accommodation 20 by moving the block holder 18 in the direction of the closure piece 16 and after a further tool head 28 has been placed between indirect punch 12 and material block accommodation 20, but before accommodating the further tool head 28 on the indirect punch 12.

In the situation shown in FIG. 4, the closure piece 16 is situated in a maximal position with a maximal distance between the closure piece 16 and the indirect punch 12, whereby the closure piece 16 or the pressing punch 13 can be moved in a straight line from the maximal position toward the indirect punch 12. A material block 22 can be introduced into the material block accommodation 20 by means of moving the closure piece 16 or the pressing punch 13 toward the indirect punch 12, whereby this functionality of the closure piece 16 or the pressing punch 13 is required for pressing the material block 22, in each instance (see also FIG. 2).

In order to implement problem-free or operationally reliable placement of the further tool head 28 between indirect punch 12 and material block accommodation 20, and also problem-free or operationally reliable accommodation of the further tool head 28 on the indirect punch 12, the maximal distance is preferably configured to be 7% greater than the sum of the expanses of the tool head 14 and of the block holder 18 in the movement direction, in other words in the direction in which the block holder 18 can be moved in a straight line by the closure piece 16, by way of the indirect punch 12.

FIG. 4 also illustrates, although only schematically, that in Step B, the further tool head 28 is placed between the indirect punch 12 and the material block accommodation 20 by a manipulator 36 of an industrial robot, which is shown very schematically, and accommodated on the further tool head 28.

Figure 5:
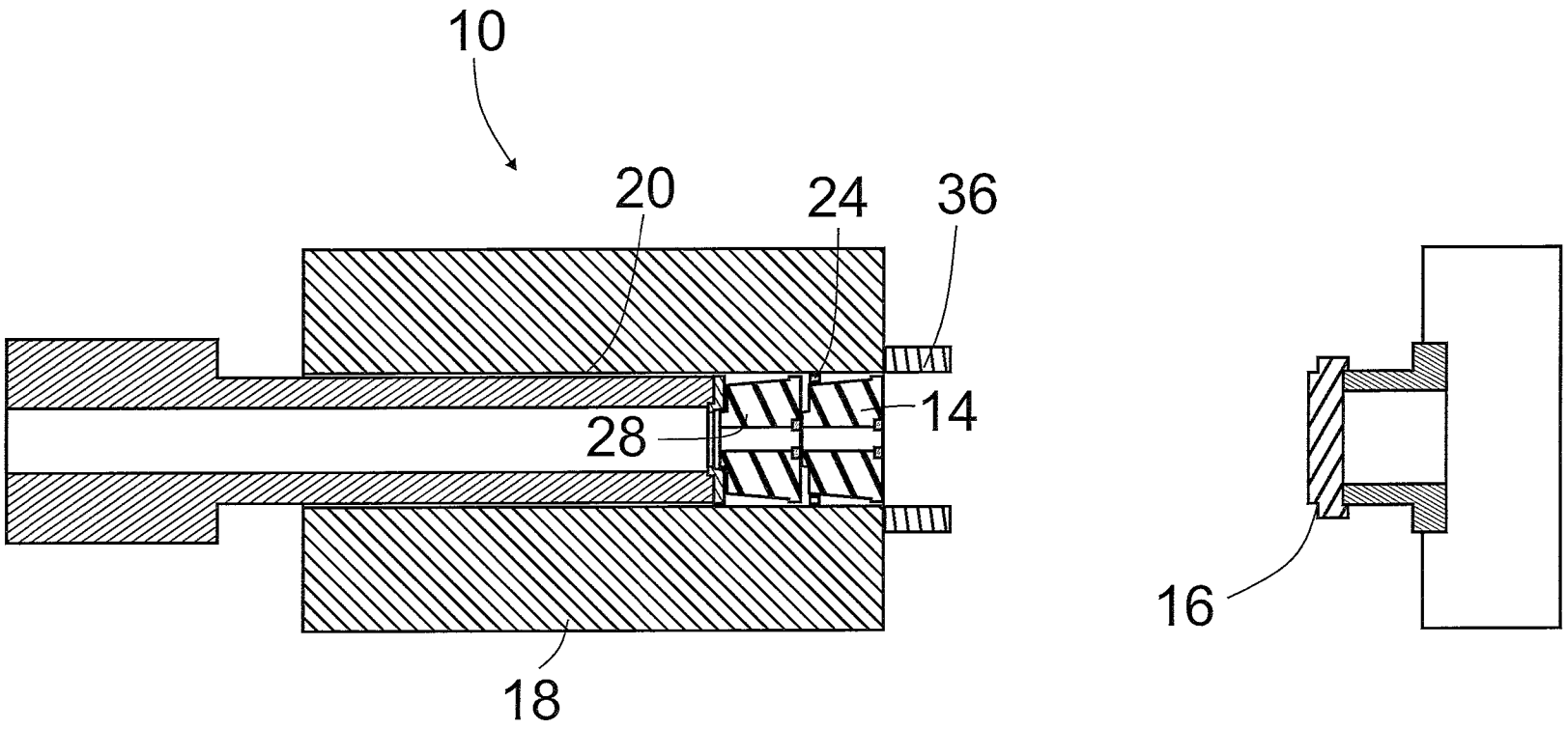

FIG. 5 illustrates the situation or the operating state after Step C of the method has been carried out, whereby Step C comprises introducing the indirect punch 12, together with the accommodated further tool head 28, into the material block accommodation 20, and bringing the further tool head 28 into contact with the other tool head 14 by means of moving the block holder 18 in the opposite direction—here, in other words, by moving it away from the closure piece 16.

Figure 6:
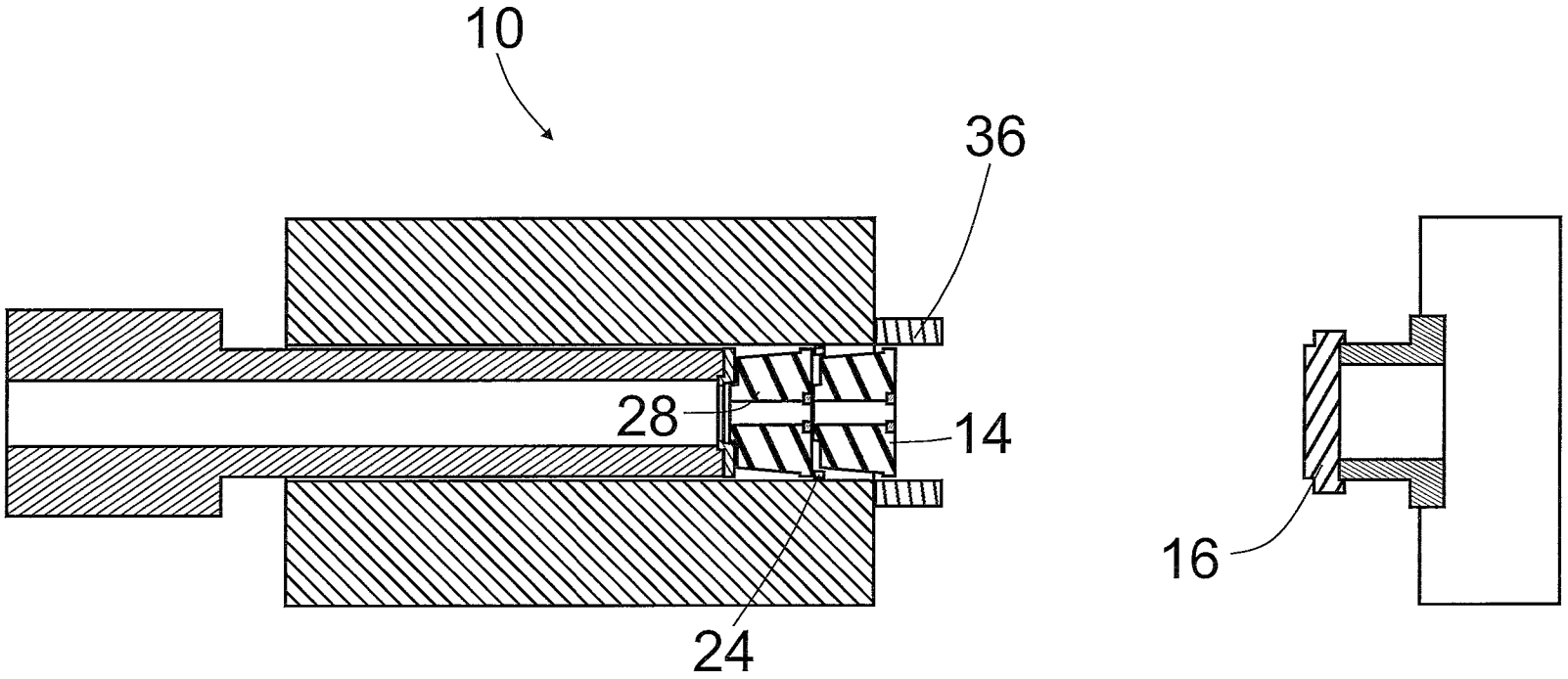

FIG. 6 illustrates the situation or the operating state of the indirect extrusion press while Step D of the method is being carried out or undertaken. Step D comprises pushing the other tool head 14 out of the material block accommodation 20 by means of moving the block holder 18 further in the opposite direction, whereby the shell 24 is partially pressed out of the material block accommodation 20 during the further movement, by means of the further tool head 28. In this connection, FIG. 6 illustrates the situation in which Step D has not yet been completely concluded, particularly the situation in which the shell 24 is still disposed in the material block accommodation 20 in its entirety.

Figure 7:
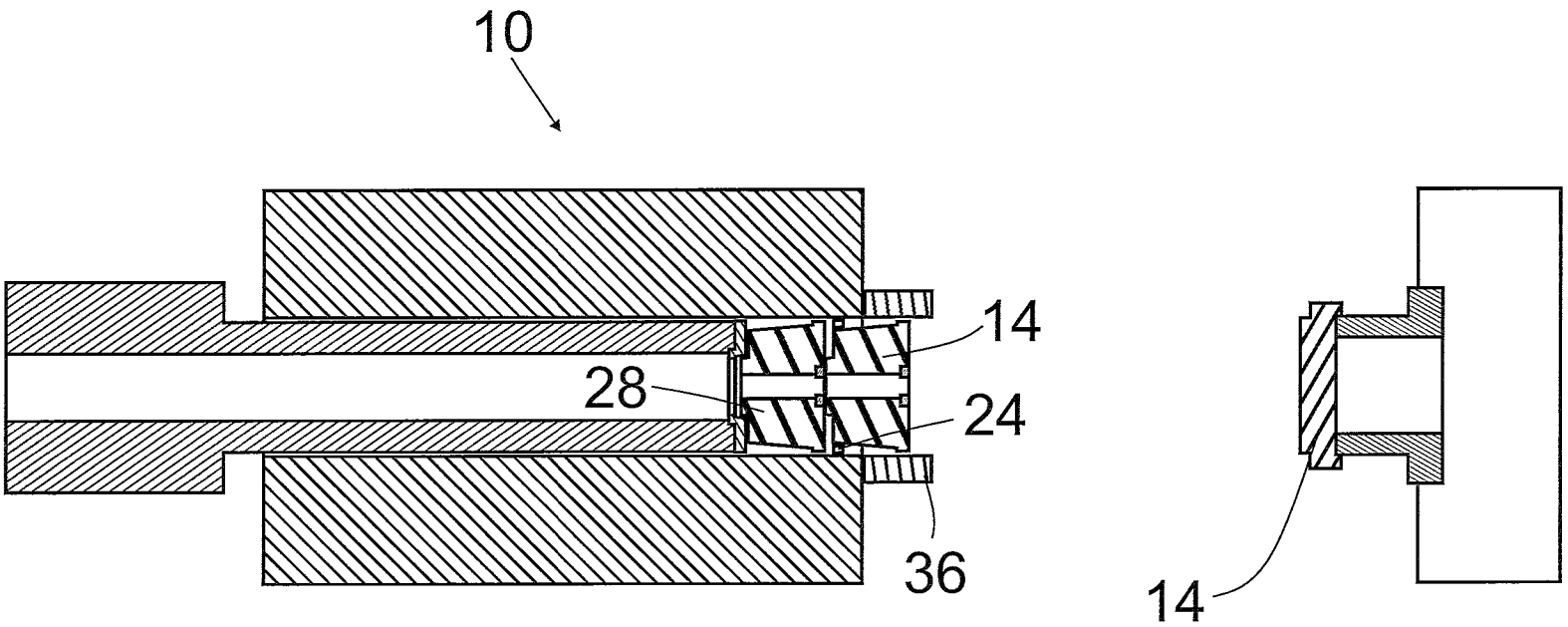

FIG. 7 also illustrates an operating state or a situation in which Step D has not been completely concluded, but shows a situation later in time as compared with the situation illustrated in FIG. 6. It can be seen in FIG. 7 that a significant section of the other tool head 14 has already been pushed out of the material block accommodation 20. This other tool head 14 is pushed into a predetermined position on a manipulator 36 of an industrial robot as it is pushed out, whereby the manipulator 36 is shown only very schematically in FIG. 7.

Figure 8:
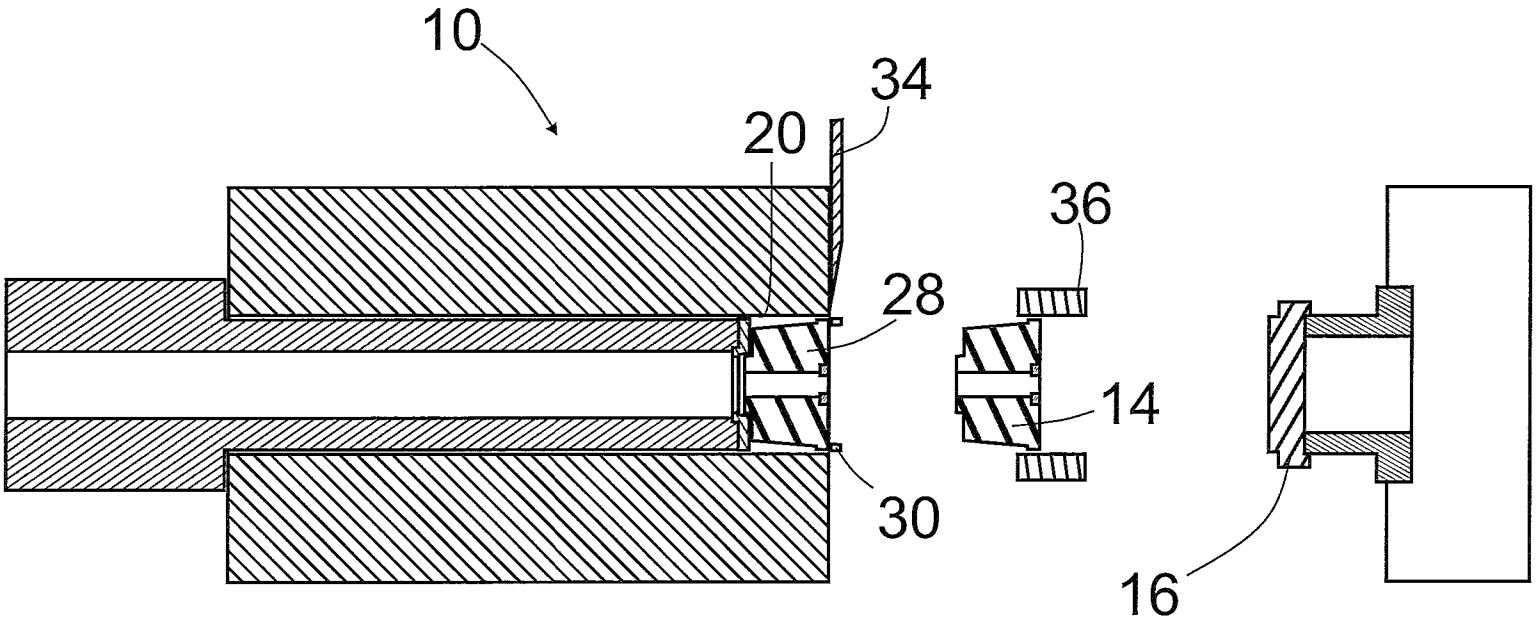

FIG. 8 illustrates the situation after the other tool head 14 has been pushed out of the material block accommodation 20 according to Step D of the method. The situation that the other tool head 14 is grasped by the manipulator 36 after having been pushed out and moved away from the block holder 18 by means of the manipulator 36 is shown here.

The shell 24 is pressed out of the material block accommodation 20, in part, by means of the further movement of the block holder 18 in the opposite direction, according to Step D of the method, by means of the further tool head 28, in the present case. In FIG. 8, the situation that the excess length 30 formed by partially pressing out the shell 24 is separated from a remnant that is only very small (not illustrated in any detail here) of the material, specifically in that the excess length 30 is sheared off by means of the shear blade 34, is also illustrated. Such a small remnant can be ignored, as such, and fills the space formed by the next tool head 28 only to an insignificant amount, so that the subsequent method sequence is not impaired by it.

Figure 9:
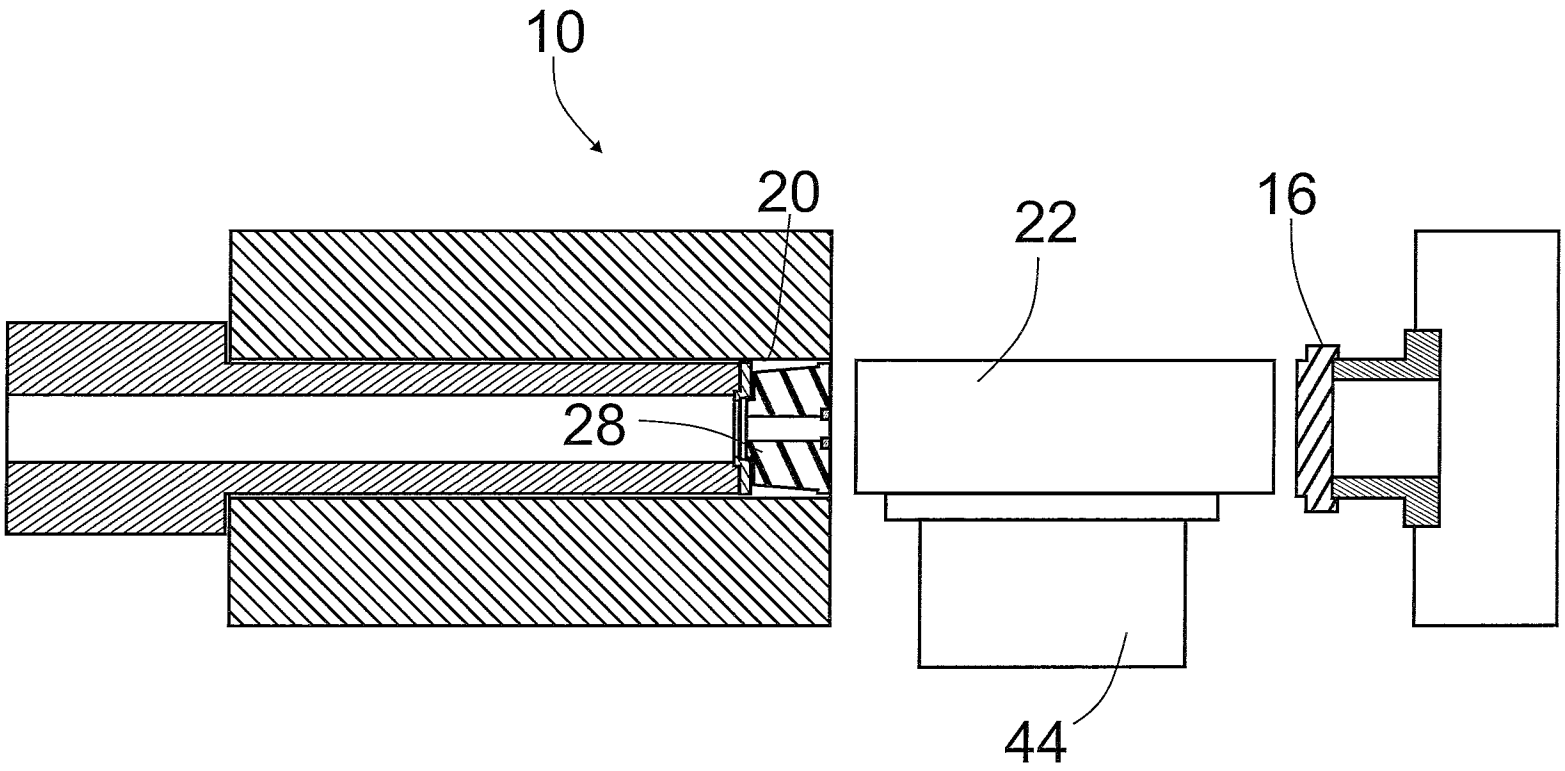
FIG. 9 shows the indirect extrusion press of FIGS. 1 to 8 together with a material block in a block loading position for preparing for a pressing procedure.

FIG. 9 illustrates the situation that is carried out after replacement of the tool head 28, for example, or also in between, if a material block 22 was pressed in its entirety, in which situation, after the further tool head 28 or the new tool head 28 has been introduced into the material block accommodation 20, a further or new material block 22 is placed in front of the further tool head 28, by means of a block loader 44, which pivots into a predetermined position for this purpose.

Although only a few embodiments of the present invention have been shown and described, it is to be understood that many changes and modifications may be made thereunto without departing from the spirit and scope of the invention.

What is claimed is:

1. A method for operating an indirect extrusion press, wherein the indirect extrusion press comprises an indirect punch having a first tool head receivable on the indirect punch, a closure piece, and a longitudinally movable block holder having a material block accommodation for accommodating a material block, wherein the block holder is movable in a straight line by the closure piece by way of the indirect punch, and wherein moving the block holder in a first direction toward the closure piece brings the indirect punch out of the material block accommodation and moving the block holder in a second direction opposite to the first direction brings the indirect punch into the material block accommodation, said method comprising:

pressing the material block and forming a shell in a shell chamber; and subsequently performing the following method steps:

(A) bringing the indirect punch out of the material block accommodation by moving the block holder in the first direction toward the closure piece;

(B) placing a second tool head between the indirect punch and the material block accommodation and accommodating the second tool head on the indirect punch;

(C) introducing the indirect punch together with the second tool head accommodated on the indirect punch into the material block accommodation and bringing the second tool head into contact with the first tool head by moving the block holder a first distance in the second direction opposite to the first direction; and (D) pushing the first tool head out of the material block accommodation by moving the block holder a second distance in the second direction;

wherein the shell is pressed at least partially out of the material block accommodation by the second tool head as the block holder moves the second distance.

2. The method according to claim 1, wherein in Step (D), after the shell has been partially pressed out of the material block accommodation, an excess length formed by the shell being partially pressed out is separated from a remnant of the material from the material block.

3. The method according to claim 2, wherein the excess length is sheared off by a shearing blade.

4. The method according to claim 1, wherein in Step (B), the second tool head is placed between the indirect punch and the material block accommodation by a manipulator of an industrial robot, and accommodated on the indirect punch.

5. The method according to claim 1, wherein in Step (D), the first tool head is pushed into a predetermined position on a manipulator of an industrial robot or in surroundings of the manipulator of the industrial robot when the first tool head is pushed out, and subsequently grasped by the manipulator and moved away from the block holder.

* * * * *